US008878040B2

(12) United States Patent
Araki et al.

(10) Patent No.: US 8,878,040 B2
(45) Date of Patent: Nov. 4, 2014

(54) MUSIC SUPPORT APPARATUS AND MUSIC SUPPORT SYSTEM

(75) Inventors: Shigehiko Araki, Moriya (JP); Masato Kobayashi, Koto-ku (JP); Hiroko Kawamura, Koto-ku (JP); Sachiko Kon, Edogawa-ku (JP)

(73) Assignee: Casting Media Inc., Tokyo (JP)

( * ) Notice: Subject to any disclaimer, the term of this patent is extended or adjusted under 35 U.S.C. 154(b) by 0 days.

(21) Appl. No.: 14/113,048

(22) PCT Filed: Jan. 26, 2012

(86) PCT No.: PCT/JP2012/051603
§ 371 (c)(1),
(2), (4) Date: Oct. 21, 2013

(87) PCT Pub. No.: WO2013/111293
PCT Pub. Date: Aug. 1, 2013

(65) Prior Publication Data
US 2014/0033903 A1 Feb. 6, 2014

(51) Int. Cl.
*G10G 1/00* (2006.01)

(52) U.S. Cl.
USPC ..... 84/601; 84/609; 84/649

(58) Field of Classification Search
USPC ..... 84/600–602, 609, 649
See application file for complete search history.

(56) References Cited

U.S. PATENT DOCUMENTS 3,562,394 A * 2/1971 Kiepe ..... 84/678
4,082,029 A * 4/1978 Rumer et al. ..... 84/484
4,976,182 A * 12/1990 Obuchi et al. ..... 84/462
5,202,526 A 4/1993 Ohya
5,400,687 A * 3/1995 Ishii ..... 84/477 R
5,760,323 A * 6/1998 Romero et al. ..... 84/470 R
5,886,273 A 3/1999 Haruyama
6,156,964 A * 12/2000 Sahai et al. ..... 84/470 R
6,582,235 B1 * 6/2003 Tsai et al. ..... 434/307 A (Continued)

FOREIGN PATENT DOCUMENTS

JP 4 13990 2/1992
JP 4 261598 9/1992

(Continued)

OTHER PUBLICATIONS

Japanese Notice of Rejection with English Translation, issued Oct. 9, 2012, in Japanese application No. 2012-531127.

(Continued)

*Primary Examiner* — David S. Warren
(74) *Attorney, Agent, or Firm* — Oblon, Spivak, McClelland, Maier & Neustadt, L.L.P.

(57) ABSTRACT

A music support apparatus includes: a display unit; a bar width calculating unit configured to set display widths of the plurality of bars at a constant width; a bar width correcting unit configured to correct the display width of the bar to which the musical symbol for changing a performance tempo is designated; and a display information generating unit configured to generate display information to be displayed on the display unit from the plurality of bars of which display widths are calculated by the bar width calculating unit and the bar width correcting unit. The display unit is configured to display the display information and a performance position display portion for displaying a current performance position, and scroll either one of the display information and the performance position display portion at a constant tempo.

9 Claims, 9 Drawing Sheets

(56) References Cited

U.S. PATENT DOCUMENTS

| | | | | |
|---|---|---|---|---|
| 7,094,960 | B2 * | 8/2006 | Ikeya et al. | 84/471 R |
| 7,119,266 | B1 * | 10/2006 | Bittner et al. | 84/477 R |
| 7,220,909 | B2 * | 5/2007 | Funaki | 84/609 |
| 7,314,992 | B2 * | 1/2008 | Funaki et al. | 84/611 |
| 7,323,629 | B2 * | 1/2008 | Somani et al. | 84/470 R |
| 7,453,035 | B1 * | 11/2008 | Evans et al. | 84/477 R |
| 7,674,970 | B2 * | 3/2010 | Ma et al. | 84/627 |
| 7,703,014 | B2 * | 4/2010 | Funaki | 715/269 |
| 8,304,642 | B1 * | 11/2012 | Bryan | 84/601 |
| 8,497,416 | B2 * | 7/2013 | Gregson | 84/609 |
| 2001/0023633 | A1 | 9/2001 | Matsumoto | |
| 2004/0007118 | A1 | 1/2004 | Holcombe | |
| 2004/0112201 | A1 * | 6/2004 | Funaki | 84/477 R |
| 2004/0112202 | A1 * | 6/2004 | Smith et al. | 84/609 |
| 2005/0016361 | A1 * | 1/2005 | Ikeya et al. | 84/602 |
| 2005/0241462 | A1 | 11/2005 | Hirano | |
| 2006/0086234 | A1 * | 4/2006 | Jarrett et al. | 84/483.2 |
| 2006/0150804 | A1 * | 7/2006 | Hiratsuka | 84/619 |
| 2006/0219089 | A1 * | 10/2006 | Funaki et al. | 84/611 |
| 2006/0254407 | A1 * | 11/2006 | Jarrett et al. | 84/601 |
| 2007/0068369 | A1 * | 3/2007 | Ito et al. | 84/616 |
| 2008/0141849 | A1 | 6/2008 | Johnston | |
| 2008/0282872 | A1 * | 11/2008 | Ma et al. | 84/627 |
| 2008/0314229 | A1 | 12/2008 | Robledo | |
| 2009/0161917 | A1 * | 6/2009 | Hori et al. | 382/113 |
| 2011/0167988 | A1 | 7/2011 | Berkovitz | |
| 2011/0239845 | A1 * | 10/2011 | Gregson | 84/477 R |
| 2013/0077447 | A1 * | 3/2013 | Hiratsuka | 367/199 |
| 2013/0112062 | A1 * | 5/2013 | Iriyama | 84/453 |
| 2014/0033903 | A1 * | 2/2014 | Araki et al. | 84/612 |
| 2014/0047971 | A1 * | 2/2014 | Akazawa et al. | 84/609 |

FOREIGN PATENT DOCUMENTS

| | | |
|---|---|---|
| JP | 9-319383 | 12/1997 |
| JP | 2000 231379 | 8/2000 |
| JP | 2006 119512 | 5/2006 |
| JP | 4751490 | 5/2011 |

OTHER PUBLICATIONS

Decision on Patent Grant with English Translation, mailed on Jan. 22, 2013 in Japanese application No. 2012-531127.

International Search Report Issued May 1, 2012 in PCT/JP12/051603 Filed Jan. 26, 2012.

Extended European Search Report issued on Aug. 25, 2014 in corresponding European patent application No. 12866616.1, citing documents AA, AB, AC, AD, AE, AF, and AG therein (9 pages).

* cited by examiner

FIG.7

| SYMBOL | CHANGE AMOUNT |
|---|---|
| *accel.* | +10% |
| *rit.* | -10% |
| *a tempo* | 0% |
| ⋮ | ⋮ |

MUSIC SUPPORT APPARATUS AND MUSIC SUPPORT SYSTEM

CROSS-REFERENCE TO RELATED APPLICATION

This application is a National Stage of PCT International Application No. PCT/JP2012/051603, filed on Jan. 26, 2012, which designates the United States, the entire contents of which are incorporated herein by reference.

FIELD

The present invention relates to a music support apparatus and a music support system for supporting a musical performance or singing with a score.

BACKGROUND

Playing an instrument or singing is sometimes performed with reference to a score. At that time, each player generally places the score on a music stand or the like and turns the page of the score by hand according to the progress of the tune so far. Depending on the instruments, the player inefficiently needs to suspend playing the instrument every time when turning the page of the score.

In light of the foregoing, for example, Patent Literature 1 proposes that a score is displayed on a display device such as a liquid crystal display without a paper-based display.

An electronic music stand described in Patent Literature 1 displays an electronic score on a liquid crystal touch panel display. When the player presses a foot pedal enabling the player to input a signal for turning the score without suspending playing the instrument, the signal for turning the score is transmitted to the electronic music stand in order to automatically turn the page of the score.

However, the electronic music stand described in Patent Literature 1 has a problem in that it is difficult to synchronize the displayed page of a full score including the scores of all the instrument parts and used by a conductor in an orchestra with the displayed page of a part score only including a score of each instrument part.

To solve the above-mentioned problem, the present applicant has proposed a score display system described in Patent Literature 2. In the score display system described in Patent Literature 2, a master unit 10*a* detects a turn of the page of a full score data displayed on a display unit 11*a*. When the turn of the page is detected, the page display information indicating the page to be displayed on the display unit 11*a* after the turn of the page is transmitted to a slave unit 10*b*. The slave unit 10*b* receives the page display information transmitted from the master unit 10*a*. When the received page display information is not within the page range displayed on the display unit 11*a* of the slave unit 10*b*, the slave unit 10*b* determines to turn the page of the part score data and turns the page of the part score data displayed on the display unit 11*a* of the slave unit 10*b*.

CITATION LIST

Patent Literature

Patent Literature 1: Japanese Patent Application Laid-Open No. 2000-231379

Patent Literature 2: Japanese Patent Publication No. 4751490

Technical Problem

However, it is necessary to automatically turn the page even without an instruction from the conductor or the like when the player or the singer refers to the score as practicing alone. To automatically turn the page without the instruction from the conductor or the like, it can be considered that the page is turned, for example, as synchronized with the performance itself. However, for example, extracting the tempo or the like from the performance for the synchronization complicates the process and possibly causes a shortage of the processing ability of a tablet terminal or the like. Thus, it can be difficult to implement the synchronization.

In light of the foregoing, it can be considered that the page is turned or the score is scrolled for display based on a predetermined time. The scroll display gives an advantage on a smaller eye motion in comparison with a turn of the page. However, in a general score, the width of the bar varies depending on the number of musical symbols such as a musical note as illustrated in FIG. 13 although the performance times in units of bars have the same length. When the scroll tempo is determined based on the tempo information described in the score, the scroll is not performed at a constant tempo. This makes it more difficult to see the score.

In light of the foregoing, an objective of the present invention is to provide a music support apparatus capable of displaying a score such that the player or the singer easily sees the score, for example, when the score is scrolled for display.

SUMMARY

According to an aspect, a music support apparatus includes: a storing unit storing score information including a plurality of bars and musical symbol information to be displayed in or around the bars, the storing unit storing performance time information for each note and rest based on the musical symbol information; a display unit capable of displaying the score information; a bar width calculating unit configured to set display widths of the plurality of bars at a constant width based on the musical symbol information; a bar width correcting unit configured to correct the display width of the bar to which the musical symbol for changing a performance tempo is designated, among the plurality of bars, based on the musical symbol for changing the performance tempo with respect the display width calculated by the bar width calculating unit; and a display information generating unit configured to generate display information to be displayed on the display unit from the plurality of bars of which display widths are calculated by the bar width calculating unit and the bar width correcting unit, wherein the display unit is configured to display the display information and a performance position display portion for displaying a current performance position, and scroll either one of the display information and the performance position display portion at a constant tempo.

According to another aspect, the music support apparatus further includes a performance time information calculating unit configured to calculate the performance time information based on the score information stored in the storing unit.

According to another aspect, the bar width correcting unit includes a change amount storing unit configured to previously store a change amount of each of the musical symbols for changing the performance tempo.

According to another aspect, the music support apparatus further includes a changing unit for changing the performance time information, and the bar width correcting unit is configured to correct the display width of the bar based on the performance time information changed with the changing unit.

According to another aspect, the score information includes a plurality of instrument parts.

According to another aspect, the music support apparatus further includes: a synchronization detecting unit configured to detect synchronization information; a synchronization information communication unit configured to receive the synchronization information and transmit the synchronization information detected by the synchronization detecting unit; and a synchronization unit configured to cause a position corresponding to the synchronization information received by the synchronization information communication unit or the synchronization information detected by the synchronization detecting unit to be displayed such that the position is aligned with the performance position display portion.

According to another aspect, the display information includes the synchronization information for synchronization with an external device, the synchronization detecting unit is configured to detect that the synchronization information is displayed on the display unit, and the synchronization information communication unit is configured to transmit the synchronization information to the external device when the synchronization detecting unit detects that the synchronization information is displayed on the display unit.

According to another aspect, the music support apparatus further includes a synchronization input unit for inputting the synchronization information, and the synchronization detecting unit is configured to detect a bar displayed on the display unit, in which a synchronization instruction is input with the synchronization input unit, and the synchronization information communication unit is configured to transmit the synchronization instruction detected by the synchronization detecting unit to an external device.

According to another aspect, a music support system includes a plurality of the music support apparatuses.

Advantageous Effects of Invention

According to an aspect, the bar width calculating unit sets the display widths of a plurality of bars at a constant width based on musical symbol information stored in the storing unit. The bar width correcting unit corrects a display width of a bar, in which the musical symbol for changing a performance tempo is indicated, with respect to a display with that has been calculated by the bar width calculating unit based on the musical symbol for changing a performance tempo, among the plurality of bars. The display information generating unit generates the display information to be displayed on the display unit from the plurality of bars of which display widths are calculated by the bar width calculating unit and the bar width correcting unit. The display unit displays the display information and a performance position display portion for displaying a current performance position, and scrolls either one of the display information and the performance position display portion at a constant tempo. Thus, the bars can be scrolled for display at a constant tempo when a scroll display is performed because the bars have the same length. Further, since the correction is performed according to a musical symbol for changing a performance tempo, the display width of a bar can be corrected according to the content of the score, for example, according to a musical symbol for doubling the length of a note from the length indicated by the note. Thus, a scroll display can be performed at a constant tempo based on the performance tempo indicated by the score.

According to an aspect, provided is the performance time information calculating unit configured to calculate the performance time information based on the score information stored in the storing unit. Thus, the performance time information for each bar can be calculated based on the note, the rest, and the like.

According to an aspect, the bar width correcting unit includes the change amount storing unit in which change amount of each musical symbol for changing a performance tempo has previously been stored. Thus, the display width can be corrected based on the change amount stored in the change amount storing unit.

According to an aspect, provided is the changing unit for changing the performance time information. The bar width correcting unit corrects the display width of the bar based on the performance time information changed by the changing unit. Thus, an inflection or the like due to, for example, the taste of the player, the singer, or the like, or the characteristics of the conductor or the like can be reflected.

According to an aspect, the score information includes a plurality of instrument parts. Thus, the other parts in addition to a performance part or a part of singing can be referred to. Further, the invention can also be applied to the score, for example, for a conductor who needs to refer to a plurality of parts.

According to an aspect, the synchronization information communication unit receives the synchronization information and transmits the synchronization information detected by the synchronization detecting unit, and the synchronization unit displays a position according to the synchronization information received by the synchronization information communication unit or the synchronization information detected by the synchronization detecting unit such that the position is aligned with the performance position display portion. Thus, the scroll display can be performed as being synchronized with an external terminal or the like.

According to an aspect, the display information includes the synchronization information for synchronizing the device with an external device. The synchronization detecting unit detects that the synchronization information is displayed on the display unit. The synchronization information communication unit transmits the synchronization information to an external device when the synchronization detecting unit detects that the synchronization information is displayed on the display unit. Thus, the synchronization with an external terminal can automatically be performed. The synchronization detecting unit detects that the position to which the synchronization information thereof is displayed on the display unit. Thus, an external terminal or the like can be synchronized with the position of the detected synchronization information.

According to an aspect, provided is the synchronization input unit configured to input the synchronization information. The synchronization detecting unit detects a bar displayed on the display unit, in which a synchronization instruction is input with the synchronization input unit. The synchronization information communication unit transmits the synchronization instruction detected by the synchronization detecting unit to an external device. Thus, the user or the like can perform synchronization at an arbitrary timing.

According to an aspect, provided are a plurality of the music support apparatuses according to any one of claims 6 to 8. This enables a plurality of music support apparatuses to synchronize with each other, and thus, for example, a plurality of players can give a performance as matching the scrolled positions.

BRIEF DESCRIPTION OF DRAWINGS

FIG. 7 is a view of a table of the change amount of each auxiliary symbol.

DESCRIPTION OF EMBODIMENTS

[First Embodiment]

Figure 1:
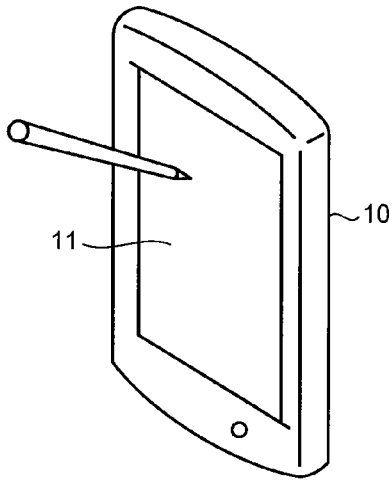
FIG. 1 is a configuration diagram of the configuration of a music support apparatus according to a first embodiment of the present invention.
Figure 2:
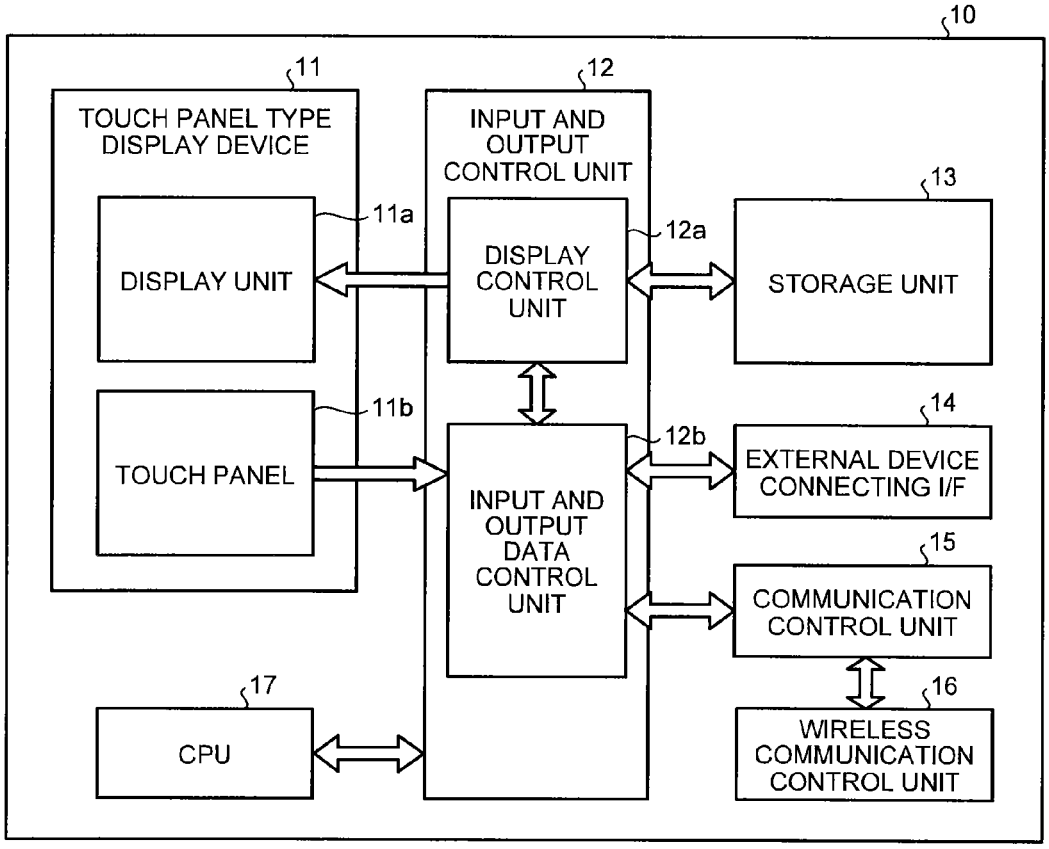
FIG. 2 is a block diagram of the block configuration of the music support apparatus illustrated in FIG. 1.

Next, the first embodiment of the present invention will be described with reference to FIGS. 1 to 8. As illustrated in FIGS. 1 and 2, a music support apparatus 10 according to the first embodiment of the present invention includes a touch panel type display device 11, an input and output control unit 12, a storage unit 13, an external device connecting I/F 14, a communication control unit 15, a wireless communication control unit 16, and a CPU 17.

The touch panel type display device 11 includes a display unit 11*a* including a liquid crystal display or the like, and a well-known touch panel 11*b* overlying on the surface of the display unit 11*a*. The display unit 11*a* displays thereon score data to be described below, a menu and button for operation, etc. Note that a unit to operate the music support apparatus 10 is not limited to the touch panel 11*b*. Another unit, such as a push button or the like, can be used.

The input and output control unit 12 includes a display control unit 12*a*, and an input and output data control unit 12*b*. The display control unit 12*a* switches the display on the display unit 11*a* and inputs and outputs data with the storage unit 13 according to the instructions from the CPU 17. The input and output data control unit 12*b* controls, for example, the reading and writing of the data from the storage unit 13, the input and output of the data with the external device connecting I/F 14, the communication control unit 15, or the like in order to operate in response to the input of the touch panel type display device 11, according to the instructions from the CPU 17.

The storage unit 13 working as a storing unit includes a hard disk drive, a non-volatile semiconductor memory or the like and saves (stores) the score data working as the score information and the performance time data working as the performance time information to be described below.

The external device connecting I/F 14 is a connecting interface (I/F) with an external device. A PC (personal computer) or a storage medium such as a memory card and an external hard disk drive, for example, is connected thereto to, for example, download or copy the score data, the performance time data and the like onto the storage unit 13.

The communication control unit 15 performs a communication control for communicating with another music support apparatus 10, a server, or the like. Note that, when the communication with another music support apparatus 10, a server, or the like is performed through a wire, the communication control unit 15 performs the communication.

The wireless communication control unit 16 performs a wireless communication with another music support apparatus 10, a server, or the like.

The CPU 17 includes a ROM, a RAM, and the like, and manages various controls in the music support apparatus 10 to perform various processes including the controls of the present embodiment according to various control programs stored in the ROM.

Figure 3:
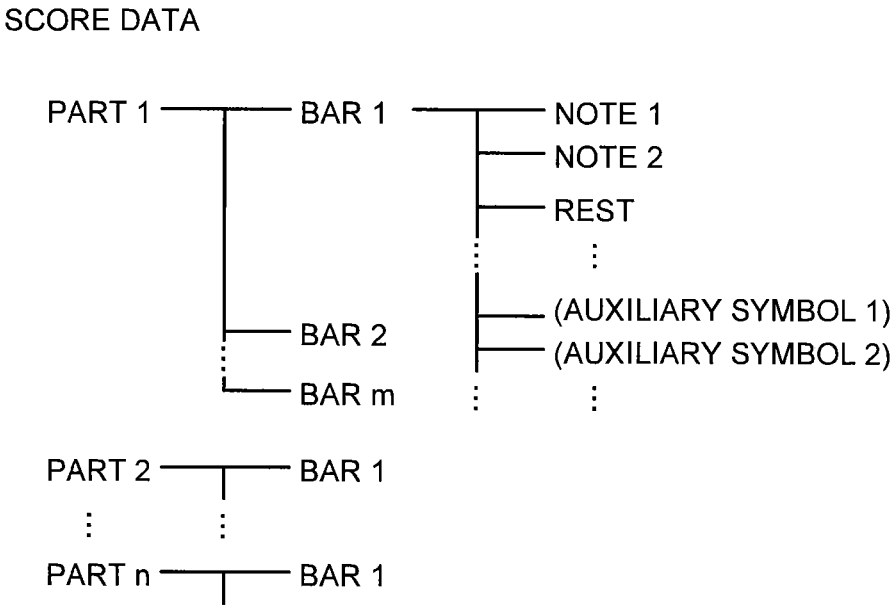
FIG. 3 is an explanatory diagram of the data configuration of the score data stored in a storage unit illustrated in FIG. 2.

Here, the data configuration of the score data stored in the storage unit 13 will be described with reference to FIGS. 3 and 4. As illustrated in FIG. 3, the score data includes one or more parts. In other words, each of the parts is for an instrument when the score is for the instruments, or each of the parts is for a voice type (for example, soprano, alto, or the like; or the main theme, the chorus, or the like) when the score is for singing. When multiple parts are included, a number, an ID, or the like is given for each of the parts to identify each of them. Each part includes a plurality of bars. A bar number (ID, or the like) is given for each of the bars to identify each of them. Each of the bars includes one or more notes and/or rests, and includes an auxiliary symbol displayed in or around the bar as necessary. Although not illustrated in the drawings, the bar includes symbols and indications such as a treble clef, a bass clef, and a metronomic indication, that have an influence on the whole score. In other words, whole the musical symbol information necessary for a score is included.

Figure 4:
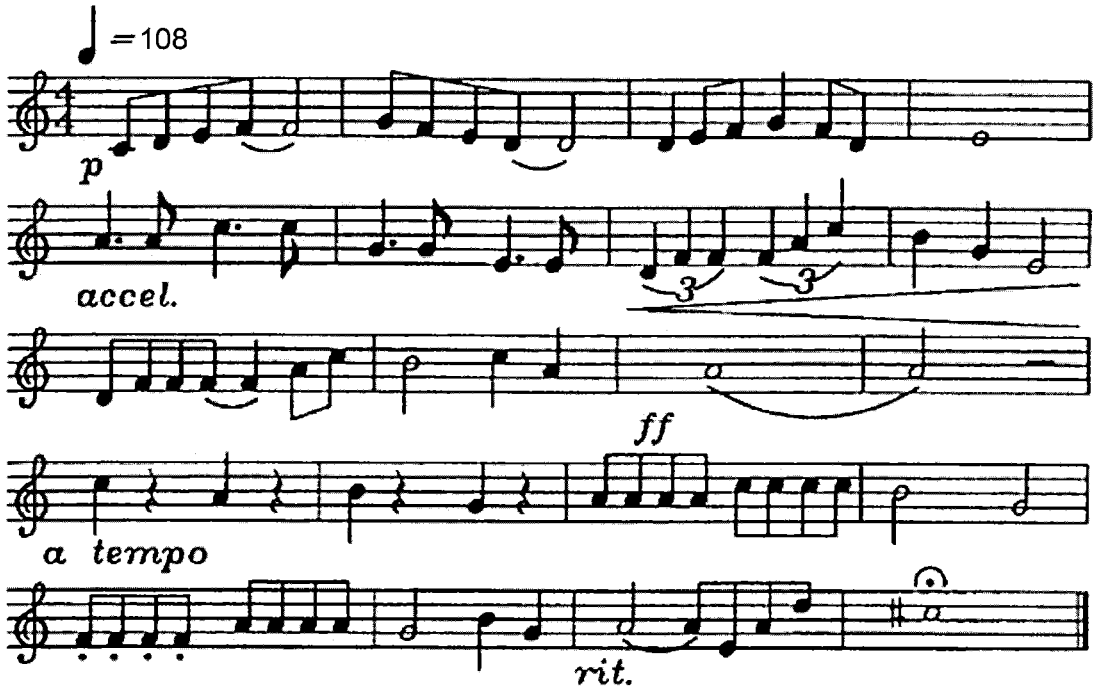
FIG. 4 is an explanatory diagram of a display of the score data illustrated in FIG. 3.

The auxiliary symbol includes musical symbols, for example, dynamic marks such as piano and forte, tempo marks such as Allegretto, accelerando (accel.), a tempo, and ritardando (rit.), marks indicating articulations such as staccato and slur, repeat marks, ornaments, and elision marks, as illustrated in FIG. 4.

The storage unit 13 further stores the time data in addition to the score data. The time data is obtained from calculating the time required for each note or rest, for example, in units of seconds based on the indication (metronomic indication) to be displayed at the top of the score, which defines the temp by the number of the quarter notes to be played within a minute. The time data is stored in association with each note and rest of the above-mentioned score data. For example, in a first bar in FIG. 4, the time data is calculated for each of four eighth notes and the following half note. Summing the time data of the notes and rests in units of bars can calculate the time data for each bar. In the present embodiment, the time data in units of notes and in units of rests and the time data in units of bars are calculated and stored in the storage unit 13.

Note that the score data is formatted, for example, as MusicXML that is an open file format for describing a score in XML format. The time data has a data configuration in which the calculated time is in association with each of the musical symbols (notes and rests) in the MusicXML.

Figure 5:
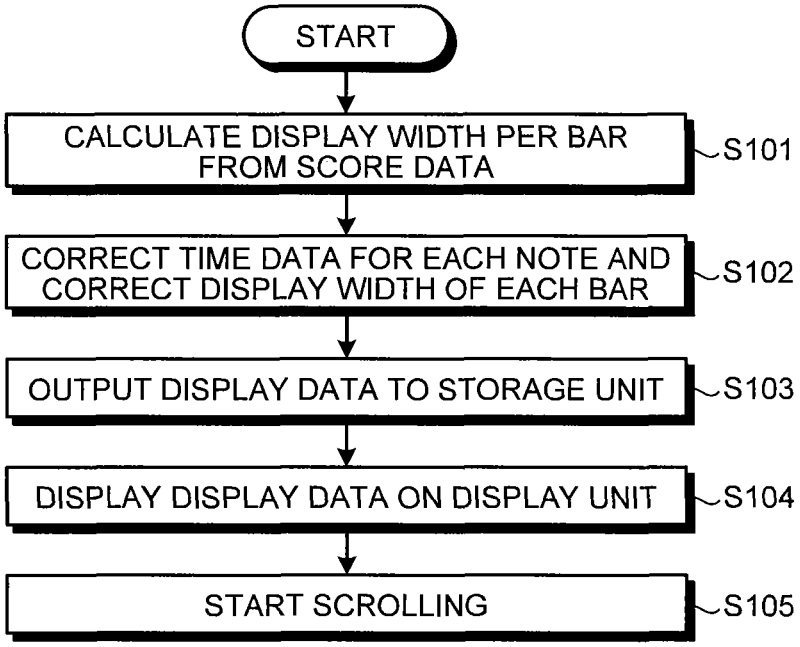
FIG. 5 is a flowchart of the operation for generating data to be displayed on a display unit from the score data in the music support apparatus illustrated in FIG. 1 and displaying the data.

Next, an operation for generating data to be displayed on the display unit 11*a* from the score data having the above-mentioned configuration, and displaying the generated data will be described with reference to the flowchart in FIG. 5. The flowchart in FIG. 5 is performed with the CPU 17.

Next, the display width per bar is calculated from the score data in step S101 and the process goes to step S102. Since the MusicXML is a standard for displaying a score, the MusicXML originally has the information about the display width per bar. In the present embodiment, the input and output control unit 12 reads the score data from the storage unit 13, for example, in order to adopt the greatest width among the widths of the bars as the display width to be displayed on the display unit 11*a*. Note that the display width can be calculated based on the number of notes per bar in the score data, or can be a predetermined fixed value. In short, at the time of the present step, what is required is that all the bars have the same display width (equal width). In other words, the display widths of a plurality of bars are set at a constant width based on the musical symbol information. It should be understood that the same display width has a value without an adverse effect on the display of the note or the like.

Next, the time data of each of the notes and the display width of each of the bars are corrected in step S102 and the process goes to step S103. The time data of each of the notes is read from the storage unit 13 to increase or decrease the performance time of each of the notes according to a symbol related to the performance tempo among the above-mentioned auxiliary symbols. The display width of each of the bars is increased or decreased in association with each note of which time has been increased or decreased. In other words, the display width of the bar to which a musical symbol for changing the performance tempo is designated among a plurality of bars is corrected based on the musical symbol for changing a performance tempo with respect to the display width calculated by a bar width calculating unit.

For example, when accelerando or ritardando is designated, the tempo of the time data of each note after the symbol is increased (or decreased) by 10%. When fermata is designated, the time data of the corresponding note is doubled. The display width per note or per rest can also be calculated because the bars have the same display width in step S102. Thus, as the display width per note is changed according to a change of the time data, the display width per bar is also changed according to the auxiliary symbol. In other words, the longer the time data becomes, the longer the display width becomes, and the shorter the time data becomes, the shorter the display width becomes.

Figure 6A:
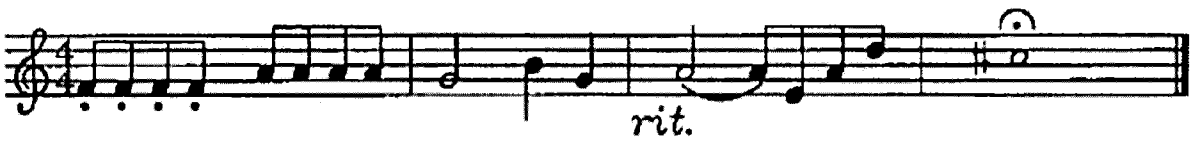
FIGS. 6A and 6B are explanatory diagrams of the correction of the display widths of bars according to an auxiliary symbol.
Figure 6B:
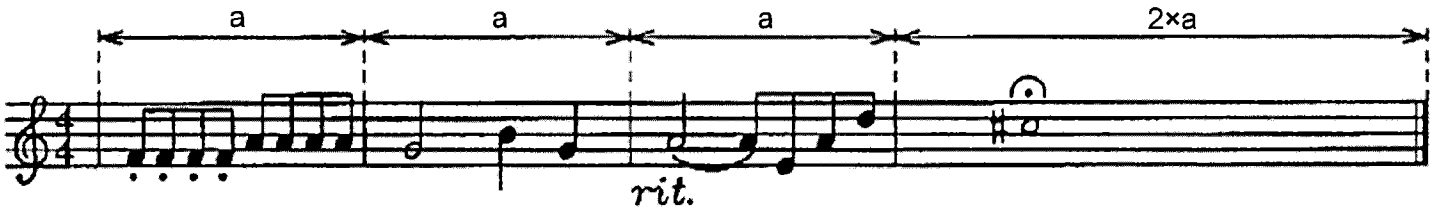

An example is illustrated in FIGS. 6A and 6B. FIG. 6A illustrates a conventional display of a score. FIG. 6B illustrates a display of a score according to the present embodiment. As illustrated in FIG. 6A, the widths of bars conventionally vary depending on the number of notes, rests and the likes in the bars. This makes it very difficult to see the score because the scroll tempo varies depending on each of the bars when the score is scrolled for display in synchronization with the performance. In light of the foregoing, the procedures in steps S101 and S102 are performed in order to temporarily equalize the display widths of the bars and then correct the display widths according to the auxiliary symbol for changing the tempo. This causes first to third bars to have the same display width (a), and a last fourth bar to have a double display width (2×a) because a whole note is marked with fermata as illustrated in FIG. 6B. When there is no auxiliary symbol for changing a performance tempo, setting the display widths of the bars at the same width can scroll the score at a constant tempo. However, when there is an auxiliary symbol for changing a performance tempo, the auxiliary symbol causes the performance time to differ from the performance time actually indicated by the note. Thus, correcting the display width in consideration of the auxiliary symbol enables scrolling the score at a constant tempo. In the examples in FIGS. 6A and 6B, the display width is corrected in the direction in which the display width is increased. It should be understood that the display width may contrarily be corrected in the direction in which the display width is decreased.

Note that the change amount of each auxiliary symbol for changing each performance tempo is previously set at a table or the like as illustrated in FIG. 7 in the CPU 17 or in a memory or the like accessible by the CPU 17. It should be understood that the amounts of change in FIG. 7 and the amounts of change of the above-mentioned time data are examples. The table may be configured so that the user can appropriately change the table. In other words, the bar width correcting unit includes a change amount storage unit (memory) in which the change amount of each musical symbol for changing a performance tempo has previously been stored.

The flowchart in FIG. 5 will be described again. The input and output control unit 12 stores the score data of which display width has been corrected as the display data to be displayed on the display unit 11*a* in the storage unit 13 in step S103 and the process goes to step S104. The display data includes MusicXML and the corrected time data similarly to the original score data. In other words, the display information to be displayed on the display unit is generated from a plurality of bars of which display widths have been calculated by the bar width calculating unit and the bar width correcting unit. In the above-mentioned steps, the CPU 17 works as the bar width calculating unit, the bar width correcting unit, and the display information generating unit.

Figure 8:
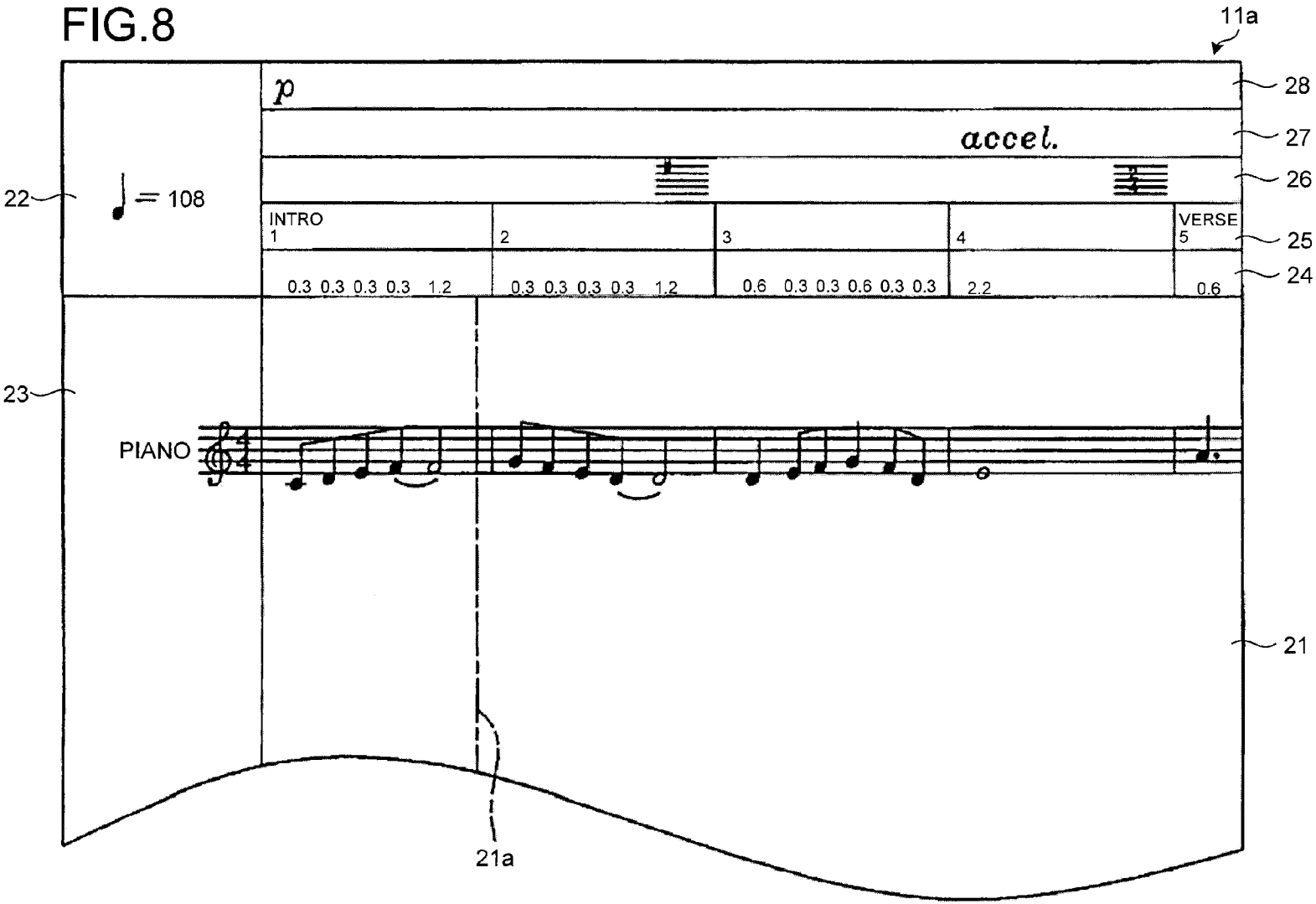
FIG. 8 is an explanatory diagram of the display on the display unit illustrated in FIG. 1.

Next, in step S104, the input and output control unit 12 receives the instruction to display the display data and corrected time data saved in the storage unit 13 on the display unit 11*a* and the process goes to step S105. FIG. 8 illustrates an exemplary display according to the present embodiment.

As illustrated in FIG. 8, a bar display region 21, a metronomic indication display region 22, an instrument part name, clef, and time signature display region 23, a bar and note time information display region 24, a bar number and score part name information display region 25, a modulation and beat switch display region 26, a tempo mark display region 27, and a dynamic mark display region 28 are displayed on the display unit 11*a*.

A plurality of bars for each instrument part including a note and a rest is displayed in a row in the lateral direction of the screen on the bar display region 21. Although a row is displayed in the illustrated example because the score includes a part, the score can include a plurality of parts. It should be understood that each bar is scrolled in the lateral direction of the screen at a constant tempo because all of the bars cannot simultaneously be displayed. The range to be displayed on the bar display region 21 at a time can arbitrarily be set. Further, a pointer 21*a* working as a performance position display portion for indicating a current performance position is displayed on the bar display region 21. The pointer 21*a* is not scrolled and remains stationary at a fixed position in the bar display region 21. The position at which the pointer 21*a* remains stationary can arbitrarily be set. Note that the display of the pointer 21*a* is not limited to the line orthogonal to the direction in which the bars are scrolled as illustrated in FIG. 8. The display of the pointer 21*a* can be any display capable of indicating the current performance position, for example, an arrow.

A metronomic indication in the score is displayed on the metronomic indication display region 22. Instrument names such as a piano and a violin, clefs such as a treble clef and a bass clef, and time signatures such as a four-four time signature are displayed on the instrument part name, clef, and time signature display region 23.

The performance time per note and the performance time per bar are displayed on the bar and note time information display region 24. Bar numbers put on the bars from the top bar and score part names such as an intro and a verse are displayed on the bar number and score part name information display region 25. The modulation and beat switch display region 26 displays a modulation and a beat change. The modulation and the beat change are displayed at the ends of the bars just before the modulation and the beat change are performed in the example of FIG. 8. However, the modulation and the beat can be displayed at the bars in which the modulation and the beat change are performed. Musical symbols for changing a tempo such as accelerando, ritardando, and fermata are displayed on the tempo mark display region 27. Dynamic marks such as piano and forte are displayed on the dynamic mark display region 28.

A modulation and a beat switch as displayed on the modulation and beat switch display region 26 are displayed within the score (staff notation) in a conventional score. However, sometimes, the player cannot respond to a sudden switch of the display on the instrument part name, clef, and time signature display region 23. Further, in the present embodiment, only a symbol that has a performance time is displayed in the staff notation because the score is scrolled at a constant tempo. Thus, providing such a region enables the player to smoothly recognize a modulation or a beat switch.

The bar and note time information display region 24, the bar number and score part name information display region 25, the modulation and beat switch display region 26, the tempo mark display region 27, and the dynamic mark display region 28 among the above-mentioned display regions are scrolled for display according to the bar display region 21. In other words, the regions are moved in response to the moving of the bars because the information related to the bars is displayed on the regions. Note that it is not necessary to display all of the bar and note time information display region 24, the bar number and score part name information display region 25, the modulation and beat switch display region 26, the tempo mark display region 27, and the dynamic mark display region 28. It may be configured such that the user can arbitrarily select a region to be displayed from among the five display regions.

The flowchart in FIG. 5 will be described again.

The bar display region 21, the bar and note time information display region 24, the bar number and score part name information display region 25, the modulation and beat switch display region 26, the tempo mark display region 27, and the dynamic mark display region 28 from among the above-mentioned display data displayed in step S104 starts to scroll for display in step S105. For example, the tap on an arbitrary position in the touch panel 11*b* by the user can trigger the start of the scroll. Inputting the trigger causes the input and output control unit 12 to read the display data from the storage unit 13 and output the display data to the display unit 11*a* such that the score is scrolled for display. In other words, the display information and the pointer indicating the performance position are displayed while the display information is scrolled at a constant tempo.

Each of the regions is scrolled at a tempo according to the metronomic indication. In other words, in the example illustrated in FIG. 8, the scroll is performed at a tempo at which the number of notes passing through the pointer 21*a* per minute is equal to 108 in terms of quarter notes. Alternatively, the scroll can be performed at a tempo designated by the user. The tempo can be designated by an input of a numeral value (metronomic indication or tempo) or by an input of the interval of two taps on the touch panel 11*b* as regarding the interval as the tempo.

According to the present embodiment, a plurality of bars is set to have the same display width according to the time data based on a note and rest stored in the storage unit 13. The display width of the bar marked with an auxiliary symbol for changing a performance tempo from among the bars is corrected based on the auxiliary symbol. Thus, display data to be displayed on the display unit 11*a* is generated. The bars of the display data are displayed in a row on the display unit 11*a* so as to scroll in the lateral direction of the screen at a constant tempo. Thus, the bars can be scrolled at a constant tempo when a scroll display is performed because the bars have the same length. Further, the display width of the bar is corrected according to the contents of the score, for example, according to auxiliary symbols for changing a performance tempo such as fermata. Thus, the display width of the bar can be corrected according to the contents of the score and the score can be scrolled for display at a constant tempo according to the performance tempo.

Further, the storage unit 13 is provided, and the time data is calculated based on the score data stored in the storage unit 13. Thus, the time data per bar can be calculated based on the note and rest.

Note that the time data can be generated by the CPU 17 based on the score data. In other words, the CPU 17 can work as a performance time information calculating unit.

Specifically, a tempo unit and the number of beats per bar are obtained from the score data stored in the storage unit 13. The tempo unit is the data corresponding to the metronomic indication. The number of beats is the data corresponding to the display indicating the time signature marked on the top of the score. The performance time per note or rest is calculated from the obtained tempo unit and the obtained number of beats. In other words, the performance time information is calculated based on the score information stored in the storage unit.

The display data is generated in the music support apparatus 10. However, for example, an external computer such as a server may previously generate the time data and the display data based on the MusicXML file and save them in the server so as to be downloaded onto the music support apparatus 10. In other words, the server or the like can perform the procedures in steps S101 to S103 of FIG. 5 and the music support apparatus 10 can perform the procedures in step S104 and the subsequence. Alternatively, it may be configured such that the server saves therein the score data and the time data and the music support apparatus 10 generates the display data.

It may be configured such that the user can finely adjust the time data corrected in step S102. For example, when the time information to be finely adjusted is tapped on the bar and note time information display region 24 in FIG. 8, a window or the like for a fine adjustment is displayed, on which the fine adjustment can be performed using a software numerical keyboard or a software keyboard for indicating the increase and decrease in a value. It should be understood that the display width of the bar of which time data has been corrected is also corrected with the correction (fine adjustment) of the time data. This enables reflecting an inflection due to, for example, the taste of the player, the singer, or the like, or the characteristics of the conductor or the like. In other words, the input from the touch panel 11*b* is obtained through the input and output control unit 12. The time data and the display width are corrected according to the input (the content of the fine adjustment). Then, the input and output control unit 12 saves the corrected data in the storage unit 13. In other words, the touch panel 11*b* works as a changing unit for changing the performance time information. The bar width correcting unit corrects the display width of the bar based on the performance time information changed with the changing unit.

Figure 9:
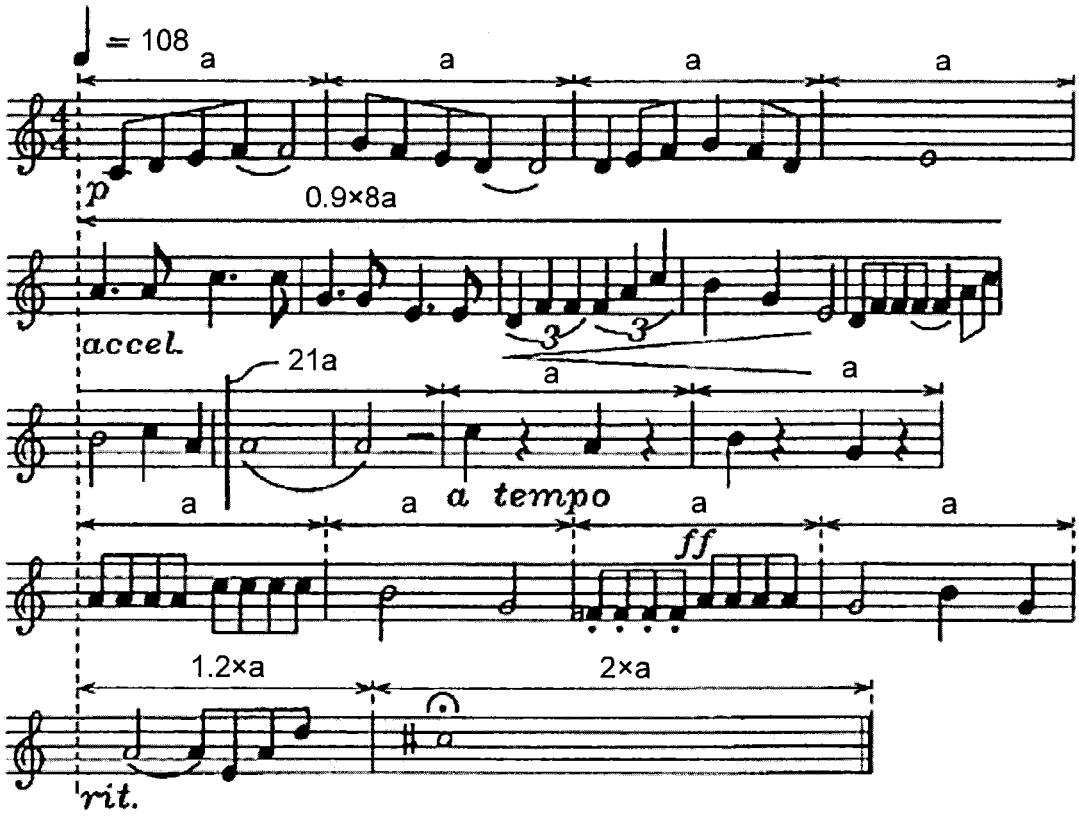
FIG. 9 is an explanatory diagram of another display of the score displayed on the music support apparatus illustrated in FIG. 1.

In the above-mentioned embodiment, the pointer 21*a* remains stationary on the display unit 11*a* while the score scrolls in a row for each instrument part. However, the pointer 21*a* (or a cursor) may be scrolled while the score is displayed in columns each including a plurality of bars as a conventional score, as illustrated in FIG. 9. Such a display can easily be implemented because it is only necessary to change the score structure in the display data (MusicXML) and configure the pointer 21*a* to be moved. Even in that case, the bars other than the bar that has been corrected according to a tempo mark have the same display width. Thus, the pointer 21*a* is scrolled sequentially from the top (upper left) bar of the displayed range to the end (lower right) bar at a tempo based on the metronomic indication. Once the pointer 21*a* reaches the end (lower right) bar of a display range, the display range is switched to a next displayed range (page) and the pointer 21*a* is scrolled from the top bar of the next displayed range.

For example, in FIG. 9, while the bars in a first column have the same width (a), the bar widths of the bars from the top bar in a second column to the bar before the bar marked with a tempo are corrected so as to gradually decrease because the top bar in a second column is marked with accelerando (accel.). In the illustrated example, the widths from the bar marked with accel. to the bar before the bar marked with a tempo are corrected, for example, so as to decrease by 10% (0.9×8a). Thereafter, the bar widths return to the equal width, and then are corrected to increase, for example, by 20% (1.2×a) due to ritardando (rit.) at the top bar in the bottom column. Then, the bar width is corrected, for example, so as to be doubled (2×a) due to fermata at the next bar.

It may also be configured such that the instrument part to be displayed on the bar display region 21 can be selected. For example, a menu screen or the like may be displayed such that the user can increase or decrease the parts to be displayed. Further, the display positions can be switched. For example, the instrument part name in the instrument part name, clef, and time signature display region 23 can be dragged and be moved up and down in order to switch the position.

[Second Embodiment]

Figure 10:
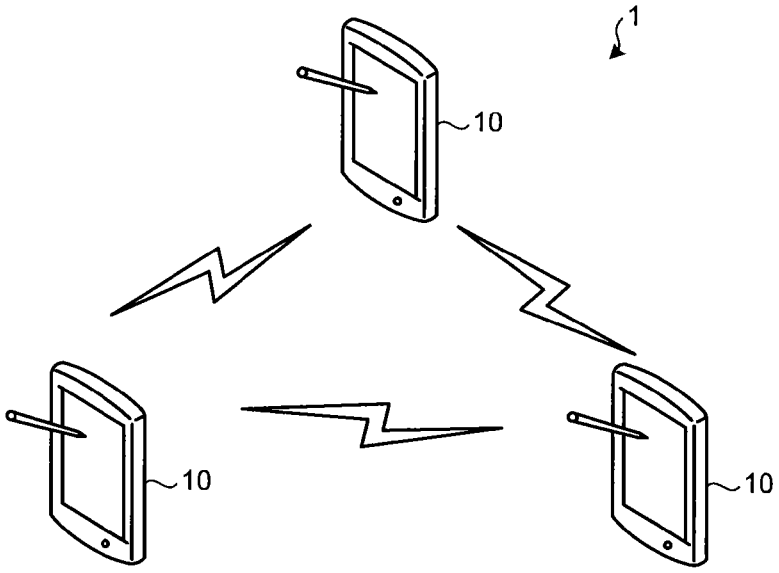
FIG. 10 is a configuration diagram of the configuration of a music support system according to a second embodiment of the present invention.
Figure 11:
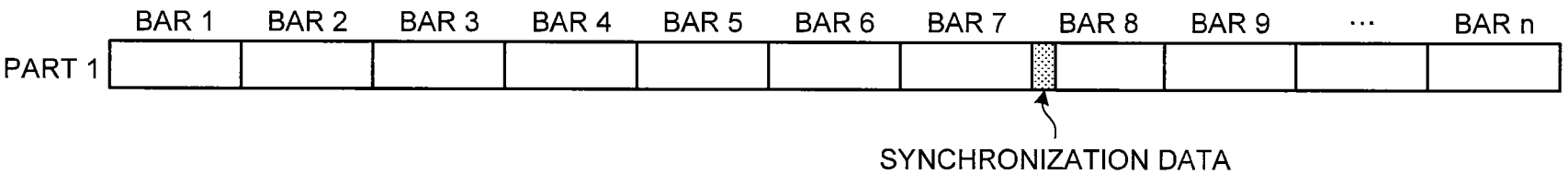
FIG. 11 is an explanatory diagram illustrating the position for inserting synchronization data.
Figure 12:
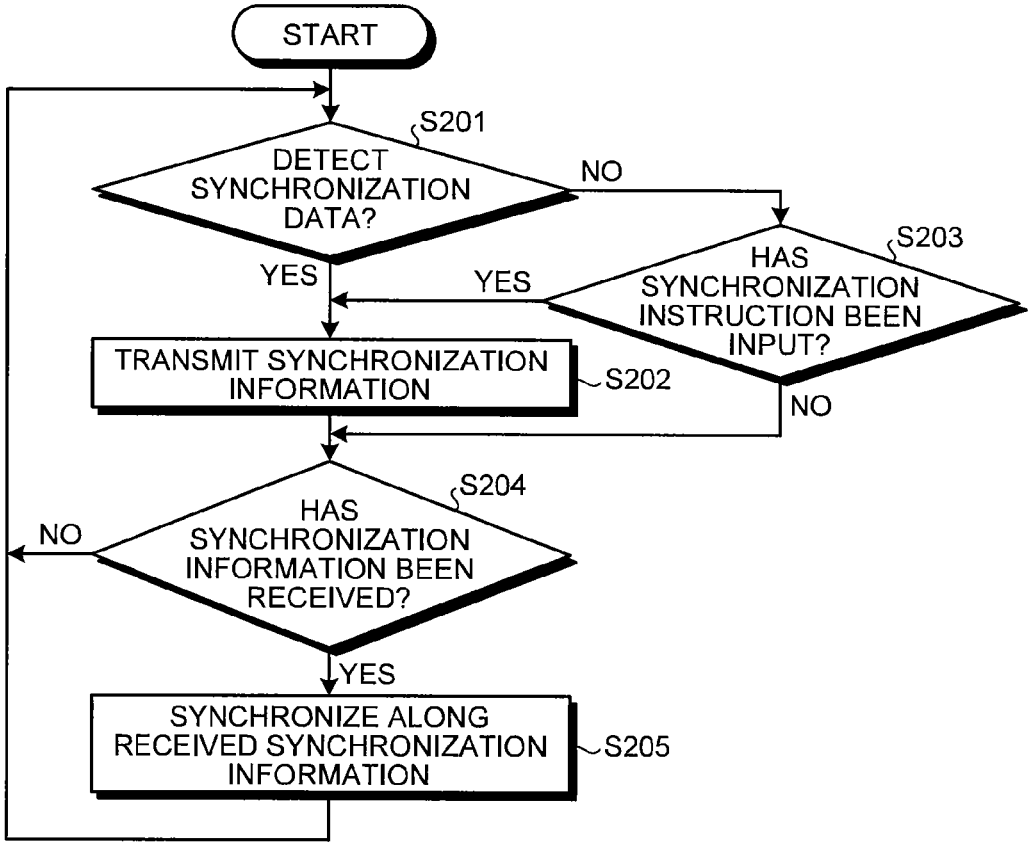
FIG. 12 is a flowchart of a synchronization operation in the music support apparatus illustrated in FIG. 10.
Figure 13:
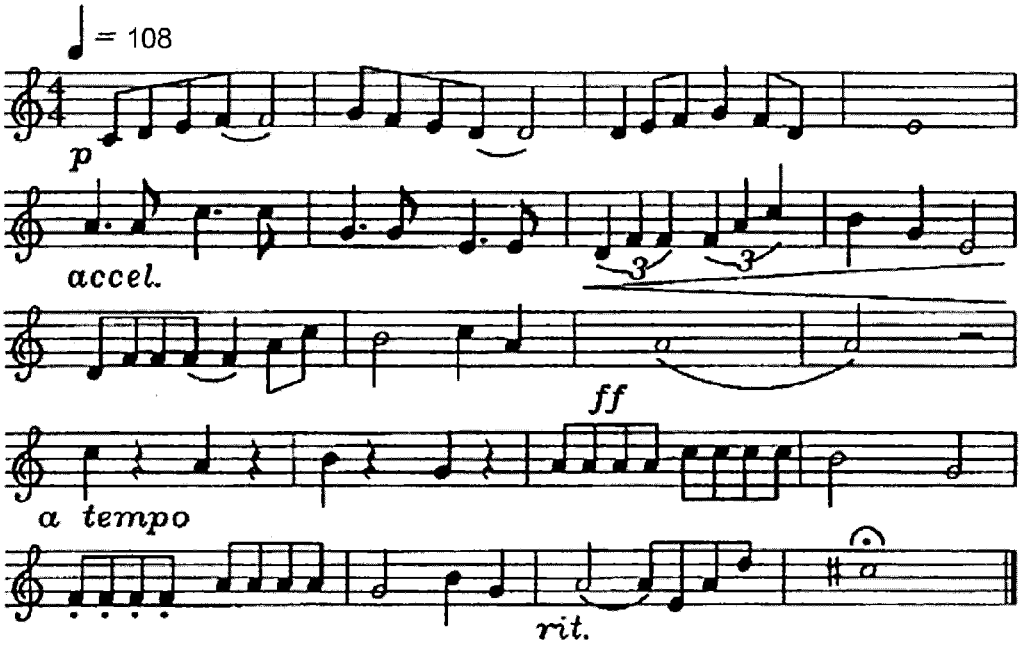
FIG. 13 is an explanatory diagram of a conventional score.

Next, a second embodiment of the present invention will be described with reference to FIGS. 10 to 12. Note that the same components as in the first embodiment will be denoted with the same reference signs and the descriptions for the same components are not repeated.

The present embodiment is a music support system 1 including a plurality of music support apparatuses 10 described in the first embodiment. When the music is played using those music support apparatuses 10, the positions indicated by pointers 21*a* may differ between the music support apparatuses 10, for example, by the time lag between the operations for starting scrolling at the respective music support apparatuses 10. In light of the foregoing, according to the present embodiment, the display positions of the music support apparatuses 10 are synchronized with each other based on the synchronization data added to the score data of the music support apparatuses 10.

As described above, the synchronization data is added to the score data in the present embodiment. The synchronization data is added at predetermined intervals. MusicXML that is in a state of score data before being converted into display data includes the information indicating page partition because being configured in consideration of the page by page display as a conventional manner. Thus, when the display data is generated, the synchronization data is added at or around the position indicating the page partition in the present embodiment. Note that the information indicating the page partition is deleted when the bars of an instrument part are displayed in a row as described in the first embodiment. FIG. 11 is an explanatory diagram illustrating an exemplary position to which the synchronization data is added. The page partition is placed between a bar 7 and a bar 8 in FIG. 11. In that case, the synchronization data is added to the top of the bar 8. In other words, the display information includes the synchronization information for synchronizing the device with an external device.

After a scroll is started, a bar number of the bar to which the synchronization data is added is transmitted to another music support apparatus 10 when the synchronization data is detected (when the top of that bar has reached the position of the pointer 21*a*). The music support apparatus 10 that has received the synchronization data moves the top of the bar indicated by the synchronization data to the position of the pointer 21*a* to synchronize the displays.

The above-mentioned operation will be described in detail with reference to the flowchart in FIG. 12. A CPU 17 performs the procedures in the flowchart of FIG. 12.

First, it is determined whether the synchronization data has been detected in step S201. When the synchronization data has been detected (in the case of Y), the process goes to step S202. When the synchronization data has not been detected (in the case of N), the process goes to step S203. In the example in FIG. 11, the synchronization data is added to the top of the bar 8, and thus when the top of the bar has reached the position of the pointer 21*a*, it is determined that the synchronization data has been detected. The input and output control unit 12 detects the synchronization data from the display data read from a storage unit 13 and notifies the CPU 17 thereof. In other words, the input and output control unit 12 works as a synchronization detecting unit to detect that the position to which the synchronization information is added is displayed on a display unit.

Next, the synchronization information is transmitted in step S202 and the process goes to step S204. The synchronization information includes the information indicating that the above-mentioned synchronization data has been detected and a bar number for the bar at which the synchronization data has been detected. The synchronization information is transmitted from a wireless communication control unit 16 through the input and output control unit 12 and a communication control unit 15 in the present step.

On the other hand, it is determined in step S203 whether a synchronization instruction has been input. When the synchronization instruction has been input, the process goes to step S202. When the synchronization instruction has not been input, the process goes to step S204. The determination in the present step is for the synchronization not according to the synchronization data previously added to the score data but according to the instruction for synchronization at an arbitrary timing by the user. As the instruction for synchronization by the user, tapping an arbitrary bar in the two scores on a touch panel 11*b* sets the bar as a bar to be synchronized (a bar to be aligned with the pointer 21*a*). Then, the same process for the synchronization data is performed in step S202. Note that, if, for example, a foot pedal is provided, the instruction for synchronization by the user can be input from the foot pedal, as well as the input from the screen. When the foot pedal is used, the synchronization is performed at the bar at which the pointer 21*a* is positioned. In other words, a synchronization input unit for inputting the synchronization information is provided so that the synchronization detecting unit detects the bar displayed on a display unit, in which the instruction for synchronization is input from the synchronization input unit.

Next, it is determined in step S204 whether the synchronization information has been received. When the synchronization information has been received (in the case of Y), the process goes to step S205. When the synchronization information has not been received (in the case of N), the process goes back to step S201. It is determined in the present step whether the wireless communication control unit 16 has received the synchronization information from another music support apparatus 10. In steps S202 to S204, the communication control unit 15 and the wireless communication control unit 16 work as a synchronization information communication unit configured to receive the synchronization information from an external device and to transmit the synchronization information to an external device when the synchronization detecting unit detects that the synchronization information is displayed on the display unit.

Next, synchronization is performed in step S205 along the received synchronization information and the process goes back to step S201. The input and output control unit 12 moves the top of the bar number included in the synchronization information received in step S204 to the position of the pointer 21*a* in the present step. In other words, the CPU 17 works as a synchronization unit for performing display such that the pointer is aligned with the position corresponding to the synchronization information received by the synchronization information communication unit.

According to the present embodiment, the synchronization information is received from an external device and the display is performed on the display unit according to the synchronization information. Thus, the display can be scrolled in synchronization with an external terminal or the like. This enables a plurality of music support apparatuses 10 to be synchronized with each other. For example, the scrolled positions can be aligned when a plurality of persons give a performance.

Synchronization is performed when the user instructs synchronization at an arbitrary timing. Thus, synchronization can be performed when synchronization data is not added or as necessary for the user.

Note that the synchronization data can be set not only at a page partition but also at an arbitrary position set by the user. Further, synchronization data can be added not only to the top of a bar but also to the end of the bar.

The two embodiments have been described mainly with an instrument performance. However, the embodiments can also be applied to a score for singing.

Note that the above-mentioned embodiments merely represents typical aspects of the present invention. The present invention is not limited to the embodiments. In other words, the present invention can be variously modified and implemented without departing from the gist thereof.

The invention claimed is:

1. A music support apparatus comprising:

a storing unit storing score information including a plurality of bars and musical symbol information to be displayed in or around the bars, the storing unit storing performance time information for each note and rest based on the musical symbol information;

a display unit capable of displaying the score information;

a bar width calculating unit configured to set display widths of the plurality of bars at a constant width based on the musical symbol information;

a bar width correcting unit configured to correct the display width of the bar to which the musical symbol for changing a performance tempo is designated, among the plurality of bars, based on a musical symbol for changing the performance tempo with respect the display width calculated by the bar width calculating unit; and a display information generating unit configured to generate display information to be displayed on the display unit from the plurality of bars of which display widths are calculated by the bar width calculating unit and the bar width correcting unit, wherein the display unit is configured to display the display information and a performance position display portion for displaying a current performance position, and scroll either one of the display information and the performance position display portion at a constant tempo.

2. The music support apparatus according to claim 1, further comprising a performance time information calculating unit configured to calculate the performance time information based on the score information stored in the storing unit.

3. The music support apparatus according to claim 1, wherein the bar width correcting unit includes a change amount storing unit configured to previously store a change amount of each of the musical symbols for changing the performance tempo.

4. The music support apparatus according to claim 1, further comprising a changing unit for changing the performance time information, wherein the bar width correcting unit is configured to correct the display width of the bar based on the performance time information changed with the changing unit.

5. The music support apparatus according to claim 1, wherein the score information includes a plurality of instrument parts.

6. The music support apparatus according to claim 1, further comprising:

a synchronization detecting unit configured to detect synchronization information;

a synchronization information communication unit configured to receive the synchronization information and transmit the synchronization information detected by the synchronization detecting unit; and a synchronization unit configured to cause a position corresponding to the synchronization information received by the synchronization information communication unit or the synchronization information detected by the synchronization detecting unit to be displayed such that the position is aligned with the performance position display portion.

7. The music support apparatus according to claim 6, wherein the display information includes the synchronization information for synchronization with an external device, the synchronization detecting unit is configured to detect that the synchronization information is displayed on the display unit, and the synchronization information communication unit is configured to transmit the synchronization information to the external device when the synchronization detecting unit detects that the synchronization information is displayed on the display unit.

8. The music support apparatus according to claim 6, further comprising a synchronization input unit for inputting the synchronization information, wherein the synchronization detecting unit is configured to detect a bar displayed on the display unit, in which a synchronization instruction is input with the synchronization input unit, and the synchronization information communication unit is configured to transmit the synchronization instruction detected by the synchronization detecting unit to an external device.

9. A music support system comprising a plurality of the music support apparatuses according to claim 6.

* * * * *